US005462432A

United States Patent [19]

Kim

[11] Patent Number: 5,462,432

[45] Date of Patent: Oct. 31, 1995

[54] GAS LIGHTER WITH IGNITION SAFETY DEVICE

[76] Inventor: Jin K. Kim, c/o Bultina America Corp. 2334 E. Valencia Dr., Fullerton, Calif. 92631

[21] Appl. No.: 261,801

[22] Filed: Jun. 17, 1994

[51] Int. Cl.[6] ..... F23D 11/36

[52] U.S. Cl. ..... 431/153; 431/255

[58] Field of Search ..... 431/153, 276, 431/277, 255

[56] References Cited

U.S. PATENT DOCUMENTS

| | | |
|---|---|---|
| 3,898,031 | 8/1975 | Rusakowicz . |
| 4,784,601 | 11/1988 | Nitta . |
| 4,784,602 | 11/1988 | Nitta . |
| 4,786,248 | 11/1988 | Nitta . |
| 4,830,603 | 5/1989 | Cirami . |
| 4,832,596 | 5/1989 | Morris, Sr. . |
| 4,859,172 | 8/1989 | Nitta . |
| 4,904,180 | 2/1990 | Nitta . |
| 5,002,482 | 3/1991 | Fairbanks et al. . |
| 5,074,781 | 12/1991 | Fujita . |
| 5,090,893 | 2/1992 | Floriot . |
| 5,145,358 | 9/1992 | Shike et al. . |
| 5,186,618 | 2/1993 | Shike et al. . |

FOREIGN PATENT DOCUMENTS

| | | |
|---|---|---|
| 0345729 | 12/1989 | European Pat. Off. . |
| 0488158 | 6/1992 | European Pat. Off. . |
| 62-180244 | 8/1987 | Japan . |
| 62-180247 | 8/1987 | Japan . |
| 63-142562 | 6/1988 | Japan . |
| 1178456 | 7/1989 | Japan . |
| 325215 | 2/1991 | Japan . |

*Primary Examiner*—Carroll B. Dority

*Attorney, Agent, or Firm*—Ostrolenk, Faber, Gerb & Soffen

[57] ABSTRACT

An ignition safety device in a gas lighter to reliably prevent ignition of the lighter when a safety button is in a locked position, and to allow ignition of the gas lighter when the safety button is moved from the first locked position to a second unlocked position. A projection of the safety button has an end surface that coacts with an end surface of a projection provided in the upper part of the gas lighter when the safety button is in its locked position. The projection in the upper part of the gas lighter is positioned so as to ensure that the two end surfaces securely contact each other. When the safety button is moved to the unlocked position, the projection of the safety button is not aligned with the projection in the upper part of the lighter and therefore, the ignition button of the lighter can be depressed to ignite the lighter.

7 Claims, 2 Drawing Sheets

GAS LIGHTER WITH IGNITION SAFETY DEVICE

BACKGROUND OF THE INVENTION

1. Field of the Invention

The present invention relates to a gas lighter, in particular a piezoelectric gas lighter having a safety device to prevent ignition of the lighter.

2. Description of Related Art

Commercially available gas lighters are dangerous if handled carelessly, particularly by young children. The inadvertent ignition of such gas lighters has resulted in fires causing property damage and injury to people. Therefore, there is a need for a safety device that prevents inadvertent ignition of gas lighters, and in particular makes the lighters difficult for children to operate. Gas lighters sold in commerce are now required by federal law to have ignition safety devices to prevent young children from being able to ignite the lighters.

In the generally available gas lighters, an actuator button, which usually is provided at the top of the lighter body, is depressed against the resistance of a spring to discharge gas fuel stored in the lighter and to actuate the ignition mechanism so that the lighter is ignited. U.S. Pat. No. 5,145,358, to Shike et al., teaches a safety device for such gas lighters including a projection that is attached to the upper part of the lighter body and extends inwardly therefrom, and another opposing part that is provided in a stopper member slidably mounted in the actuator button. When the stopper member is in a locked position, the projection and the opposing part are aligned with each other to prevent depression of the actuator button. When the stopper member is moved relative to the actuator button to an unlocked position, the opposing part of the stopper member is moved out of alignment with the projection in the lighter body and, therefore, the actuator button can be depressed to ignite the lighter.

This lighter, however, is complicated to manufacture because a portion of the actuator button must be cut out so that the button is movable into the lighter body despite the projection which is attached to the lighter body. Moreover, since the projection extends inwardly a short distance from the lighter body, only a limited surface area of the projection is available for contact with the opposing part of the stopper member. Therefore, the safety device could malfunction if the actuator button is pressed down hard, and the gas lighter ignited even though the stopper member is in its locked position.

SUMMARY OF THE INVENTION

It is a purpose of the present invention to provide gas lighters with an ignition safety device which reliably prevents ignition of the lighters when in a locked position.

The device includes a first projection provided in a space defined at an upper end of the lighter by a wall of the lighter housing. The first projection is spaced away from the wall and, in a preferred embodiment, has a first slanted end surface. An ignition button is also disposed at the upper end of the lighter and located relative to the space for movement to an operative position for actuating an ignition means to ignite the lighter, and a safety button is structured and arranged to be movable relative to the ignition button from a first position to a second position. The safety button has a second projection extending toward the first projection in the space at the upper end of the lighter. In a preferred embodiment, the second projection includes a second slanted end surface, which is slanted in a direction opposite to the slant of the first slanted end surface of the first projection. In the first position of the safety button, the second projection contacts the first projection to prevent movement of the ignition button to the operative position. The second projection does not contact the first projection in the second position of the safety button so that the ignition button is movable to the operative position.

The first projection also has a side portion opposed to the wall of the housing so that a slot is defined between the side portion and the wall of the housing. A portion of the ignition button slides in the slot when the ignition button is moved to and from the operative position.

As used herein, ignition means includes any suitable ignition mechanism, such as a piezoelectric ignition mechanism or the like, a suitable reservoir for storing fuel for the lighter, such as gas fuel for a gas lighter, and a suitable valve mechanism for controlling the release of the fuel from the reservoir.

The inventors have found that gas lighters equipped with the safety device of the present invention are difficult to ignite when young children are asked to try to do so. Since the first projection is separated from the wall of the lighter housing a greater surface area for contact with the second projection is provided so that the ignition button cannot be moved to its operative position, even when pressed down hard, while the safety button is in its locked position. Accordingly, the safety device of the present invention provides a more effective mechanism for preventing inadvertent ignition of the lighter. Moreover, the shapes of the contact areas of the two projections relative to one another provide an additional safety feature, which prevents the safety device from being inadvertently released, so that an effective and foolproof mechanism for preventing inadvertent ignition of the gas lighter is obtained.

Other features and advantages of the present invention will become apparent from the following description of the invention which refers to the accompanying drawings.

DETAILED DESCRIPTION OF A PREFERRED EMBODIMENT OF THE INVENTION

Figure 1:
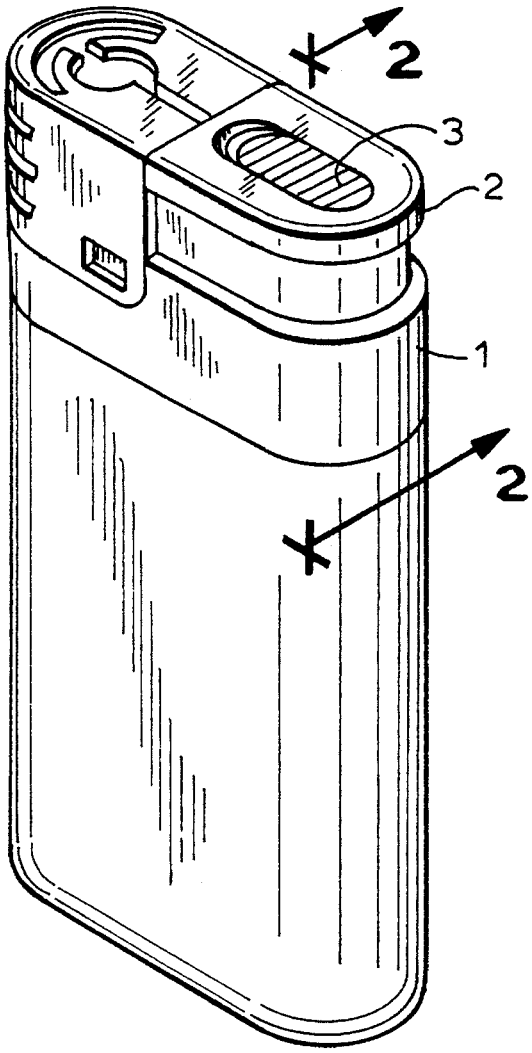
FIG. 1 is a perspective view showing a gas lighter according to an embodiment of the present invention.

FIG. 1 shows a lighter 1 illustrating certain principles of the invention, which has a housing 10, an ignition button 12 at its upper end, and a safety button 13 also at its upper end. The safety button 13 is slidably retained in a slot 20 in the ignition button 12, and is movable laterally relative to the ignition button 12 from a locked position (as shown in FIG. 1) along the direction shown by the horizontal arrow in FIG. 1 to an unlocked position. When the safety button 13 is in its unlocked position, the ignition button 12 is movable in the direction shown by the vertical arrow in FIG. 1 to actuate the means for igniting the lighter 1.

Figure 2:
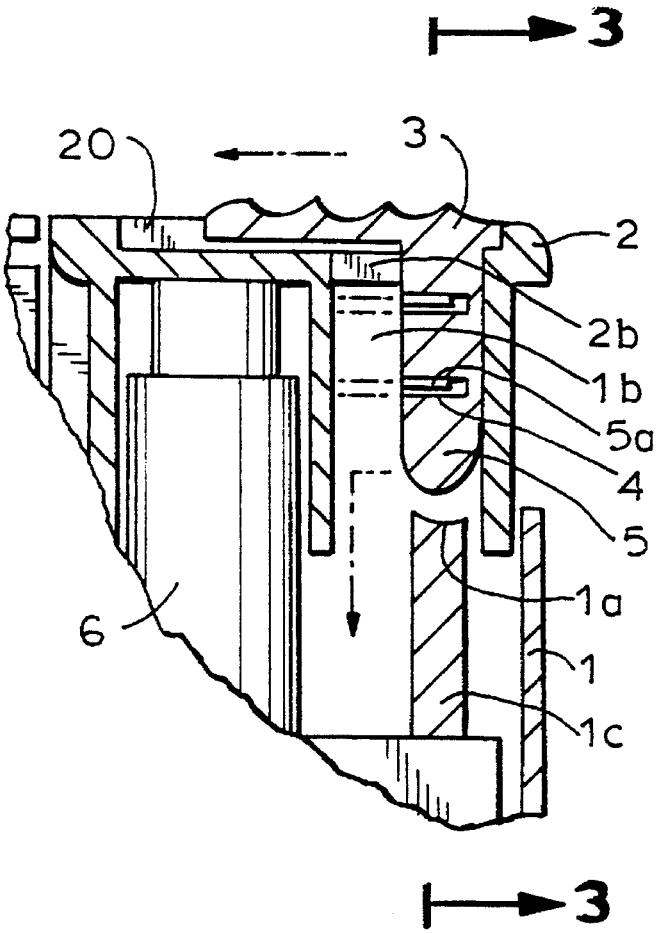
FIG. 2 is a fragmentary sectional view along line 2—2 of FIG. 1 showing a safety device of the lighter in a locked position.

FIG. 2 shows a wall 14 of the housing 10, which defines a space 15 at an upper end of the lighter 1. A conventional piezoelectric ignition mechanism 16 is positioned in the space 15 in vertical alignment with the ignition button 12. The ignition button 12 is movable downward into the space 15 (as shown by the arrow and broken lines in FIG. 4) into engagement with the piezoelectric mechanism 16. The ignition button 12 is movable upwardly out of the space 15 under the urging of a spring (not shown) of the piezoelectric ignition mechanism 16. When the ignition button 12 is depressed into the space 15, it activates a valve (not shown) of a conventional gas fuel reservoir (not shown) so that gas fuel stored in the reservoir is discharged and, at the same time, actuates the piezoelectric ignition mechanism 16 to ignite the gas fuel.

Figure 4:
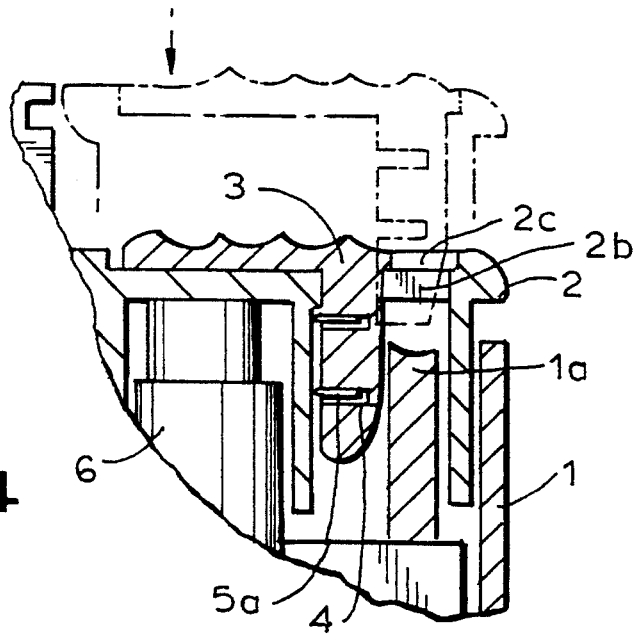
FIG. 4 is a sectional view similar to FIG. 2 showing the safety device unlocked and an ignition button in a depressed position at which the lighter is ignited.

A vertical projection 17 is also provided in the space 15. As shown in FIGS. 2 and 4, the projection 17 is laterally spaced away from the wall 14 to define a slot 11 therebetween. The projection 17 has a top end surface 17*a* and a side portion 17*b* which is opposed to the wall 14. Advantageously, as is evident from FIGS. 2 and 4, the top end surface 17*a* of the projection 17 is shaped, i.e., has a slant. Although, in FIGS. 2 and 4 a generally concave, slanted shape is shown for the top end surface 17*a* of the projection 17, as discussed below, any suitable or preferred shape may be used instead.

The safety button 13 is slidably retained in the slot 20 in the ignition button 12 and is movable laterally relative to the ignition button 12 between the locked position (shown in FIGS. 1 and 2) and the unlocked position (shown in FIG. 4 and by the arrows in FIG. 2). The safety button 13 includes a downwardly extending projection 13*a*. In the locked position of the safety button 13, the projection 13*a* is aligned with the projection 17 (as shown in FIG. 2) so that a bottom end surface 13*b* of the projection 13*a* contacts the end surface 17*a* of the projection 17 if .the ignition button 12 is depressed. Accordingly, the end surface 13*b* of the projection 13*a* coacts with the end surface 17*a* of the projection 17 to prevent complete depression of the ignition button 12 for igniting the lighter. In the unlocked position of the safety button 13, the projection 13*a* is out of alignment with the projection 17 (as shown in FIG. 4) so that the end surface 13*b* of the projection 13*a* does not contact the end surface 17*a* of the projection 17 when the ignition button 12 is depressed. Therefore, the ignition button 12 can be completely depressed to ignite the lighter.

Advantageously, as shown in FIGS. 2 and 4, the end surface 13*b* of the projection 13*a* is shaped, i.e., has a slant. It is preferred that the surfaces 17*a* and 13*b* be shaped relative to one another so as to oppose each other. In particular, the shapes of the surfaces 17*a* and 13*b*, preferably, should be such that the projection 13*a* is effectively blocked or obstructed by the projection 17 in the locked position of the safety button 13, and the surface 13*b* does not slip off the surface 17*a* if the ignition button 12 is pressed down hard. Preferably, the surface 17*a* is slanted downwardly and rearwardly (as viewed in FIGS. 2 and 4) and the surface 13*b* is slanted upwardly and rearwardly (as viewed in FIGS. 2 and 4).

Figure 3:
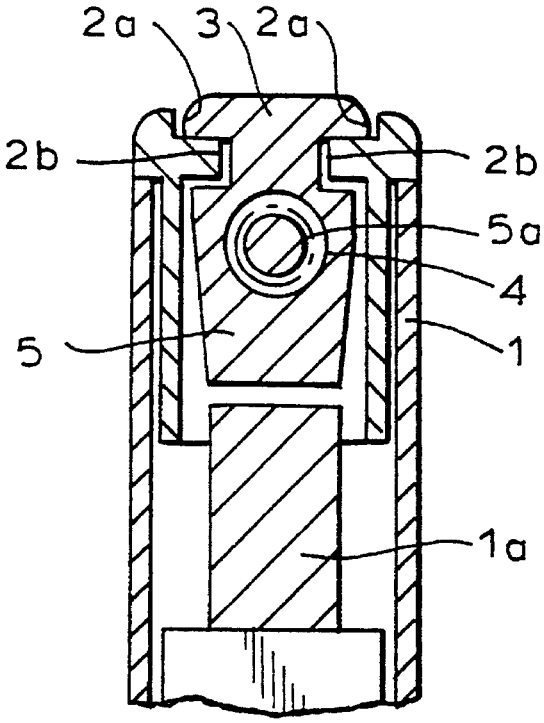
FIG. 3 is a sectional view along line 3—3 of FIG. 2 with portions removed for the sake of clarity.
Figure 1:
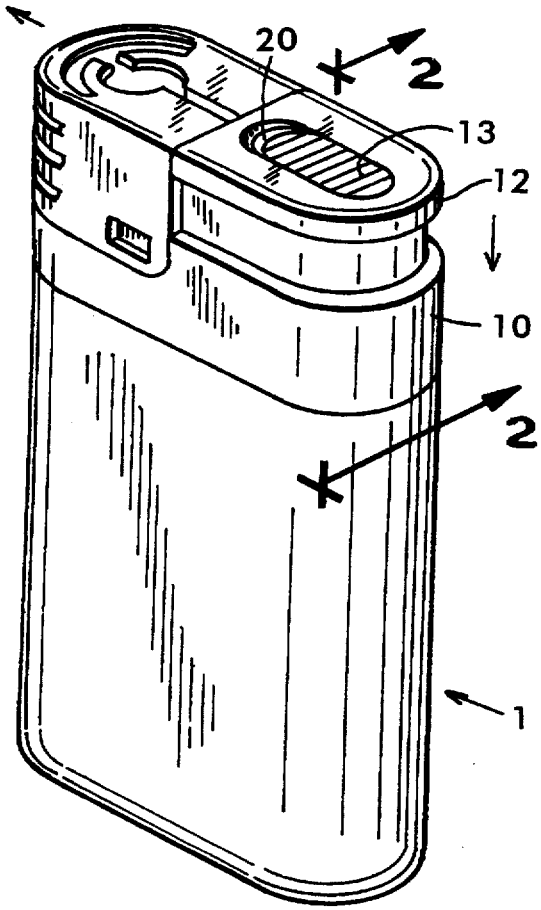
Figure 4:
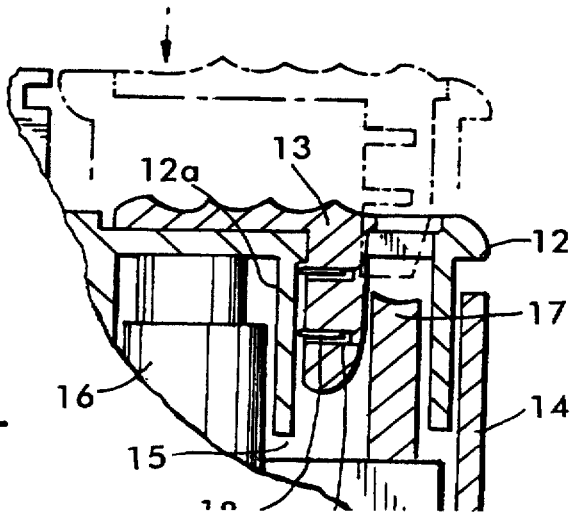
Figure 2:
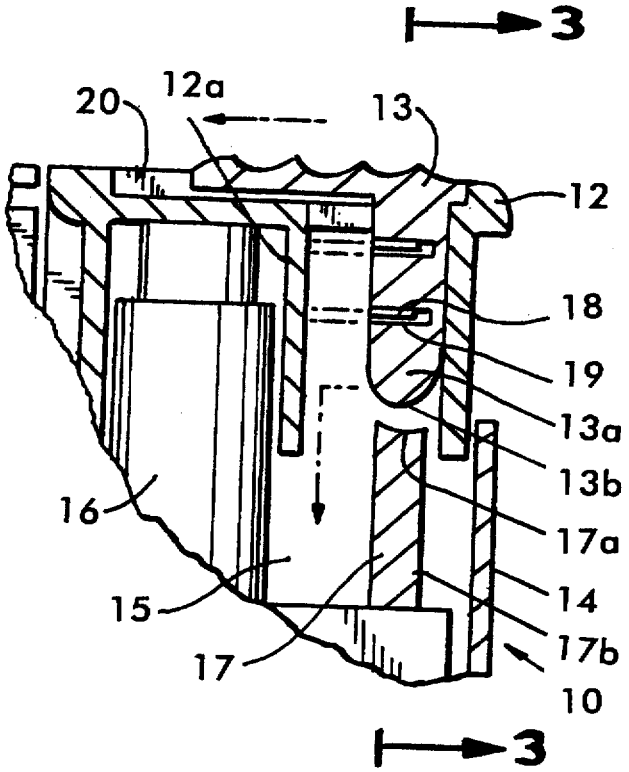
Figure 3:
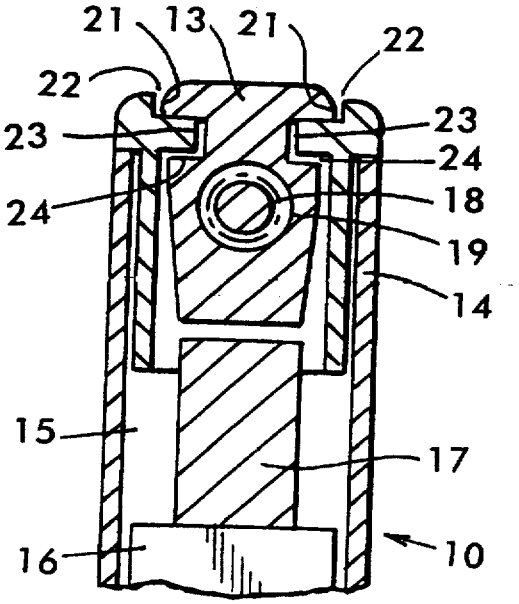

The safety button 13 is slidably received in the slot 20 in the ignition button 12. Springs 18 are located in holes 19 of the safety button 13. The springs 18 are interposed between a downwardly projecting leg 12*a* of the ignition button 12 and end walls of the holes 19 to urge the safety button 13 toward the locked position shown in FIGS. 1 and 2. A coil spring, plate spring or the like may be used as the springs 18. FIGS. 2 and 4 show a pair of springs 18, while FIG. 3 shows only a single spring 18. As is evident, any type or number of springs that are suitable may be used.

As shown in FIG. 3, when the safety button 13 is in the slot 20 of the ignition button 12, tab portions 21 of the safety button 13 are positioned in recessed portion 22 of the slot 20 and abut against the shoulders 23 of the slot 20. Engagement portions 24 of the safety button 13 are positioned at the lower end portion of the slot 20 so that the safety button 13 is slidably retained in the slot 20.

As described previously, in the locked position, the lower surface 13*b* of the safety button 13 is aligned with the upper surface 17*a* of the projection 17 and depression of the ignition button 12 is prevented. The safety button 13 can be moved with a finger to the unlocked position shown in FIG. 4 against the resistance of the springs 18. In the unlocked position, the projection 13*a* of the safety button 13 is out of alignment with the projection 17, therefore the end surface 13*b* is not obstructed by the projection 17 and does not contact the projection 17 when the ignition button 12 is moved downwardly so that the ignition button 12 may be fully depressed (see FIG. 4) to ignite the lighter 1.

When the ignition button 12 is released after depression and ignition of the lighter 1, the safety button 13 is also released and is pushed toward the locked position by the springs 18. However, the safety button 13 does not return to the locked position until the ignition button 12 is moved upward sufficiently high since the projection 13*a* abuts against and slides on the inner surface of the projection 17 (as shown in FIG. 4). While the lighter is not being used, the safety button 13 is held in the locked position shown in FIGS. 1 and 2 where it prevents depression of the ignition button 12. In this state, ignition of the lighter is disabled and the lighter cannot be inadvertently ignited by, for example, young children. Thus a highly safe gas lighter having an auto-return function in which the locked position is automatically restored is obtained. Moreover, because the operation of the safety device 13 and ignition button 12 can be done at the same time the safety device of the present invention is more convenient to use than the safety device in other gas lighters.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A gas lighter with a safety device to prevent ignition of the lighter, the gas lighter comprising:

a housing and ignition means in the housing, the ignition means being actuable for igniting the lighter, and the housing including a wall defining a space at an upper end of the lighter;

a first projection provided in the space at a location spaced away from the wall; an ignition button at the upper end of the lighter, the ignition button being located relative to the space for movement to an operative position for actuating the ignition means to ignite the lighter; and a safety button provided at the upper end of the lighter and structured and arranged to be movable relative to the ignition button from a first position to a second position, the safety button having a second projection extending toward the first projection in the space at the upper end of the lighter, wherein in the first position of the safety button the second projection contacts the first projection to prevent movement of the ignition button to the operative position, and in the second position of the safety button the second projection does not contact the first projection so that the ignition button is movable to the operative position.

2. The gas lighter of claim 1, wherein the first projection and the second projection have respective surfaces which contact one another in the first position of the safety button, the respective surfaces being shaped relative to one another such that upon contact movement of the ignition button to the operative position is prevented.

3. The gas lighter of claim 1, wherein the first projection has a first slanted end surface and the second projection has a second slanted end surface that is slanted in a direction opposite to the slant of the first slanted end surface of the first projection, the first slanted end surface contacting the second slanted end surface in the first position of the safety button to prevent movement of the ignition button to the operative position.

4. The gas lighter of claim 1, wherein the first projection further comprises a side portion opposed to the wall of the housing, a slot being defined between the side portion and the wall of the housing, and a portion of the ignition button sliding in the slot when the ignition button is moved to and from the operative position.

5. A gas lighter comprising:

a housing and ignition means in the housing, the ignition means being actuable for igniting the lighter, and the housing including a wall defining a space at an upper end of the lighter;

a first vertical projection provided in the space, the first projection extending upwardly in the space at a location spaced away from the wall, and having a shaped end portion at a top end of the first projection;

an ignition button at the upper end of the lighter, the ignition button being movable downwardly into the space from an inoperative position to an operative position for actuating the ignition means to ignite the lighter, a slot formed in a top surface of the ignition button; and a safety button slidably retained in the slot formed in the ignition button, the safety button being slidable from a first position to a second position and spring means between the safety button and the ignition button for urging the safety button toward the first position;

a second vertical projection attached to the safety button and extending downwardly therefrom toward the first projection in the space at the upper end of the lighter, wherein in the first position of the safety button the second projection contacts the shaped end portion of the first projection to prevent movement of the ignition button to the operative position, and in the second position of the safety button the second projection does not contact the first projection so that the ignition button is movable to the operative position.

6. The gas lighter of claim 5, wherein the second projection has an end surface at a lower end thereof, the shaped end portion of the first projection and the end surface of the second projection being relatively shaped for contact to prevent movement of the ignition button to the operative position.

7. The gas lighter of claim 5, wherein the shaped end portion of the first projection has a slant, and the second projection has a slanted end surface that is slanted in a direction opposite to the slant of the shaped end portion of the first projection, the shaped end portion of the first projection contacts the slanted end surface to prevent movement of the ignition button to the operative position.

* * * * *

UNITED STATES PATENT AND TRADEMARK OFFICE

CERTIFICATE OF CORRECTION

PATENT NO. : 5,462,432
DATED : October 31, 1995
INVENTOR(S) : Jin Ki Kim

It is certified that error appears in the above-identified patent and that said Letters Patent is hereby corrected as shown below:

Two Replacement Drawing Sheets With All Of The Figures 1-4.

Signed and Sealed this

Eighteenth Day of December, 2001

*Attest:*

*Attesting Officer*

JAMES E. ROGAN
*Director of the United States Patent and Trademark Office*